US007238634B2

(12) United States Patent
Bansal et al.

(10) Patent No.: US 7,238,634 B2
(45) Date of Patent: Jul. 3, 2007

(54) MULTIPLE COMPONENT SPUNBOND WEB

(75) Inventors: Vishal Bansal, Overland Park, KS (US); Sam Louis Samuels, Landenberg, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 83 days.

(21) Appl. No.: 11/296,875

(22) Filed: Dec. 8, 2005

(65) Prior Publication Data

US 2006/0093818 A1 May 4, 2006

Related U.S. Application Data

(62) Division of application No. 10/627,569, filed on Jul. 24, 2003, now Pat. No. 7,008,888.

(51) Int. Cl.
*B32B 5/26* (2006.01)
*D04H 1/00* (2006.01)

(52) U.S. Cl. ..... 442/381; 442/382; 442/364

(58) Field of Classification Search ..... 442/268, 442/319, 364, 382, 400, 401, 381, 389
See application file for complete search history.

(56) References Cited

U.S. PATENT DOCUMENTS

| | | | | |
|---|---|---|---|---|
| 5,108,827 | A | 4/1992 | Gessner | |
| 5,277,974 | A | 1/1994 | Kubo et al. | |
| 5,284,489 | A * | 2/1994 | Liu et al. | 606/228 |
| 5,372,885 | A | 12/1994 | Tabor et al. | |
| 5,643,662 | A | 7/1997 | Yeo et al. | |
| 5,807,796 | A * | 9/1998 | Degrand et al. | 442/398 |
| 5,948,529 | A * | 9/1999 | Hastie | 428/373 |
| 6,162,852 | A * | 12/2000 | Honeycutt et al. | 524/423 |
| 6,458,726 | B1 | 10/2002 | Harrington et al. | |
| 2003/0148691 | A1 | 8/2003 | Pelham, Sr. et al. | |

FOREIGN PATENT DOCUMENTS

| | | | |
|---|---|---|---|
| EP | 0 260 941 | A2 | 3/1988 |
| EP | 0 311 860 | A2 | 4/1989 |
| EP | 0311860 | * | 4/1989 |
| EP | 0 351 318 | A2 | 1/1990 |
| EP | 0 366 379 | A2 | 5/1990 |
| EP | 0 465 203 | A1 | 1/1992 |
| EP | 0465203 | * | 1/1992 |
| EP | 0 597 224 | A2 | 5/1994 |
| EP | 0 924 328 | A1 | 6/1999 |
| EP | 1 022 125 | A1 | 7/2000 |
| JP | HEI 8-325849 | A | 12/1996 |
| JP | 950854 | B2 | 9/1999 |
| KR | 1991-0004459 | B1 | 6/1991 |
| WO | WO 01/57316 | A1 | 8/2001 |

* cited by examiner

*Primary Examiner*—N. Edwards

(57) ABSTRACT

A multiple component spunbond web is provided in which the spunbond fibers are polymeric sheath-core fibers with a sheath made of a blend of polyethylene and an acid copolymer and a polyester or polyamide core. The spunbond webs can be thermally bonded have an improved combination of strength, softness, and heat sealability and can be used to prepare multi-layer composite sheets including spunbond-meltblown-spunbond fabrics suitable for use in medical garments and other end uses.

15 Claims, No Drawings

MULTIPLE COMPONENT SPUNBOND WEB

BACKGROUND OF THE INVENTION

This invention relates to multiple component spunbond nonwoven fabrics and composite sheets thereof, that are soft, strong, and have improved thermal bonding properties.

Sheath-core staple fibers that comprise a sheath polymer having a lower melting point than the core polymer are known in the art for use as binder fibers. Binder fibers are staple fibers that can be used alone or in blends with other staple fibers to form a nonwoven web that can be bonded by heating to a temperature that is sufficient to activate the binder fibers, causing the surface of the binder fibers to adhere to adjacent fibers. Ahn et al. EPO Published Application No. 0366379 describes sheath/core binder fibers having a polyester core and a sheath consisting essentially of an organic copolymer of ethylene and a polar co-monomer. Kim et al. Korean Patent No. 9104459 describes sheath-core staple fibers suitable for use as binder fibers wherein the sheath is prepared by adding 0.1-10 weight percent of an ionomer to high density polyethylene or normal chain low density polyethylene. Kubo et al. U.S. Pat. No. 5,277,974 describes heat bondable binder fibers comprising a sheath component formed of ethylene co-polymerized with at least one component selected from the group consisting of an unsaturated carboxylic acid, a derivative thereof, and an unsaturated carboxylic anhydride in an amount of 0.1-5 mole percent, and a core component formed from a fiber-forming polymer having a melting point at least 30° C. higher than the copolymer sheath. In certain end uses, for example medical garments, such staple-based products may not have sufficient surface stability, resulting in release of fibers from the fabric during use (linting). The strength of such materials may also be lower than desired.

Spunbond nonwovens formed from sheath-core fibers that comprise a sheath polymer that melts at a lower temperature than the core polymer are also known. For example, Terakawa et al. U.S. Pat. No. 6,187,699 describes multi-layer nonwoven fabrics that comprise a composite spunbond nonwoven fabric composed of multiple component spunbond fibers formed from a low melting point resin and a high melting point resin wherein the low-melting resin component forms at least a part of the spunbond fiber surface. The spunbond fibers can be spun in a sheath-core configuration, side-by-side, or multi-layer configuration. The spunbond nonwoven is described as a partial thermal fusion product of the multiple component spunbond fibers by the mediation of the low melting point resin.

Multi-layer nonwoven laminates comprising spunbond and melt-blown layers, such as spunbond-meltblown-spunbond ("SMS") nonwovens are also known in the art. The exterior layers of a SMS nonwoven fabric are spunbond nonwoven webs that contribute strength to the overall composite, while the middle or core layer comprises a meltblown web that provides barrier properties. Similarly, composite nonwovens comprising additional layers of spunbond or meltblown webs can be prepared, as in spunbond-meltblown-meltblown-spun bond ("SM MS") nonwovens.

It is also known to form thermally-bonded nonwoven fabrics that comprise fibers made from blends of a lower melting polymer and a higher melting polymer. Gessner U.S. Pat. No. 5,294,482 describes a thermally-bonded nonwoven fabric comprising multiconstituent fibers composed of a highly dispersed blend of at least two different immiscible thermoplastic polymers that has a dominant continuous polymer phase and at least one non-continuous phase dispersed therein. The polymer of the non-continuous phase has a polymer melt temperature at least 30° C. below the polymer melt temperature of the continuous phase and the fiber is configured such that the non-continuous phase occupies a substantial portion of the fiber surface. Harrington U.S. Pat. No. 6,458,726 describes thermally bonded nonwoven fabrics comprising skin-core fibers wherein the fibers are composed of a polymer blend of a polyolefin and a polymeric bond curve enhancing agent, such as ethylene vinyl acetate polymers. The polyolefin is preferably polypropylene and the skin layer is produced by oxidation, degradation and/or lowering of the molecular weight of the polymer blend at the surface of the fiber compared to the polymer blend in an inner core of the fiber. Thus, the skin-core structure comprises a modification of a blend of polymers to obtain the skin-core structure and does not comprise separate components being joined along an axially extending interface, such as in sheath-core and side-by-side bicomponent fibers.

For certain nonwoven end uses, it is desirable that the nonwoven fabric have good heat-sealing properties when thermally bonded to an identical nonwoven fabric layer or to a dissimilar layer such as a nonwoven fabric comprising fibers of a different polymer composition. For example in protective apparel uses such as medical garments, it may be desirable to prepare the garments by heat-sealing the seams to avoid formation of holes that occurs when needles are inserted during stitching. Alternately, reinforcing pieces may be thermally bonded in place instead of using an adhesive or stitching process. In addition to good heat-sealing properties, it is desirable that the nonwoven fabrics have high strength while also being as soft and drapeable as possible. For medical end uses, it is also desirable that the nonwoven fabrics be made of fibers of polymers that can be sterilized with gamma radiation. SMS fabrics have traditionally been polypropylene-based and have the limitation that they cannot be sterilized with gamma radiation because the fabrics are discolored and weakened as a result of the sterilization process. In addition, gamma-irradiation of polypropylene based fabrics results in the generation of unpleasant odors. This presents a significant problem for polypropylene-based SMS fabrics because radiation sterilization is commonly used throughout the medical industry.

There remains a need for low-cost nonwoven fabrics that have an improved combination of strength, softness, and heat sealability and that can be sterilized by gamma radiation without significantly degrading the properties of the fabric and/or generating unpleasant odors.

BRIEF SUMMARY OF THE INVENTION

One embodiment of the present invention is a multiple component spunbond nonwoven web comprising polymeric sheath-core substantially continuous spunbond fibers wherein the sheath component comprises a blend comprising polyethylene and between about 5 and 30 weight percent of an acid copolymer selected from the group consisting of copolymers of ethylene with methacrylic acid, acrylic acid, or a combination thereof, metal salts of said copolymers, and blends thereof, the core component comprises a polymer selected from the group consisting of polyesters and polyamides, and the weight ratio of sheath component to core component is between about 10:90 and 90:10.

In another embodiment of the present invention, the multiple component spunbond web of the present invention is thermally bonded to one or more additional sheet-like layers to form a multi-layer composite sheet.

DETAILED DESCRIPTION OF THE INVENTION

The present invention is directed toward a multiple component spunbond web comprising substantially continuous polymeric sheath-core spunbond fibers. The polymeric sheath component of the substantially continuous multiple component sheath-core spunbond fibers comprises a blend comprising polyethylene and an acid copolymer. The acid copolymer is selected from the group consisting of copolymers of ethylene with methacrylic acid, acrylic acid, or a combination thereof, metal salts of said copolymers, and blends thereof. The polymeric core component of the substantially continuous multiple component sheath-core spunbond fibers comprises a polymer selected from the group consisting of polyesters and polyamides. The present invention is also directed to multi-layer composite sheet structures in which at least one of the layers comprises the multiple component sheath-core spunbond web.

The term "copolymer" as used herein includes random, block, alternating, and graft copolymers prepared by polymerizing two or more comonomers and thus includes dipolymers, terpolymers, etc.

The term "polyethylene" (PE) as used herein is intended to encompass not only homopolymers of ethylene, but also copolymers wherein at least 85% of the recurring units are ethylene units.

The term "linear low density polyethylene" (LLDPE) as used herein refers to linear ethylene/α-olefin co-polymers having a density of less than about 0.955 g/cm$^3$, preferably in the range of 0.91 g/cm$^3$ to 0.95 g/cm$^3$, and more preferably in the range of 0.92 g/cm$^3$ to 0.95 g/cm$^3$. Linear low density polyethylenes are prepared by co-polymerizing ethylene with minor amounts of an alpha, beta-ethylenically unsaturated alkene co-monomer (α-olefin), the α-olefin co-monomer having from 3 to 12 carbons per α-olefin molecule, and preferably from 4 to 8 carbons per α-olefin molecule. Alpha-olefins that can be co-polymerized with ethylene to produce LLDPE's include propylene, 1-butene, 1-pentene, 1-hexene, 1-octene, 1-decene, or a mixture thereof. Preferably, the α-olefin is 1-hexene or 1-octene.

The term "high density polyethylene" (HDPE) as used herein refers to polyethylene homopolymer having a density of at least about 0.94 g/cm$^3$, and preferably in the range of about 0.94 g/cm$^3$ to about 0.965 g/cm$^3$.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. Examples of polyesters include poly (ethylene terephthalate) (PET) which is a condensation product of ethylene glycol and terephthalic acid and poly (1,3-propylene terephthalate) which is a condensation product of 1,3-propanediol and terephthalic acid.

The term "polyamide" as used herein is intended to embrace polymers containing recurring amide (—CONH—) groups. One class of polyamides is prepared by copolymerizing one or more dicarboxylic acids with one or more diamines. Examples of polyamides suitable for use in the present invention include poly(hexamethylene adipamide) (nylon 6,6) and polycaprolactam (nylon 6).

The term "ionomer" as used herein refers to metal salts of ethylene copolymers that include a plurality of comonomers derived from an ethylenically unsaturated carboxylic acid or anhydride precursor of an ethylenically unsaturated carboxylic acid. At least a portion of the carboxylic acid groups or acid anhydride groups are neutralized to form salts of univalent or multivalent metal cations.

The term "nonwoven fabric, sheet, layer or web" as used herein means a structure of individual fibers, filaments, or threads that are positioned in a random manner to form a planar material without an identifiable pattern, as opposed to a knitted or woven fabric. Examples of nonwoven fabrics include meltblown webs, spunbond webs, carded webs, air-laid webs, wet-laid webs, and spunlaced webs and composite webs comprising more than one nonwoven layer.

The term "multi-layer composite sheet" as used herein refers to a multi-layer structure comprising at least first and second sheet-like layers wherein at least the first layer is a nonwoven fabric. The second layer can be a nonwoven fabric (same as or different than the first layer), woven fabric, knitted fabric, or a film.

The term "machine direction" (MD) is used herein to refer to the direction in which a nonwoven web is produced (e.g. the direction of travel of the supporting surface upon which the fibers are laid down during formation of the nonwoven web). The term "cross direction" (XD) refers to the direction generally perpendicular to the machine direction in the plane of the web.

The term "spunbond fibers" as used herein means fibers that are formed by extruding molten thermoplastic polymer material as fibers from a plurality of fine, usually circular, capillaries of a spinneret with the diameter of the extruded fibers then being rapidly reduced by drawing and then quenching the fibers. Other fiber cross-sectional shapes such as oval, multi-lobal, etc. can also be used. Spunbond fibers are generally substantially continuous and usually have an average diameter of greater than about 5 micrometers. Spunbond nonwoven fabrics or webs are formed by laying spunbond fibers randomly on a collecting surface such as a foraminous screen or belt. Spunbond webs are generally bonded by methods known in the art such as by hot-roll calendering or by passing the web through a saturated-steam chamber at an elevated pressure. For example, the web can be thermally point bonded at a plurality of thermal bond points located across the spunbond fabric.

The term "meltblown fibers" as used herein, means fibers that are formed by meltblowing, which comprises extruding a melt-processable polymer through a plurality of capillaries as molten streams into a high velocity gas (e.g. air) stream. The high velocity gas stream attenuates the streams of molten thermoplastic polymer material to reduce their diameter and form meltblown fibers having a diameter between about 0.5 and 10 micrometers. Meltblown fibers are generally discontinuous fibers but can also be continuous. Meltblown fibers carried by the high velocity gas stream are generally deposited on a collecting surface to form a meltblown web of randomly dispersed fibers. Meltblown fibers can be tacky when they are deposited on the collecting surface, which generally results in bonding between the meltblown fibers in the meltblown web. Meltblown webs can also be bonded using methods known in the art, such as thermal bonding.

The term "spunlaced nonwoven web" as used herein refers to a nonwoven fabric that is produced by entangling fibers in the web to provide a strong fabric that is free of binders. For example, a spunlaced fabric can be prepared by supporting a nonwoven web of fibers on a porous support such as a mesh screen and passing the supported web underneath water jets, such as in a hydraulic needling process. The fibers can be entangled in a repeating pattern.

The term "spunbond-meltblown-spunbond nonwoven fabric" (SMS) as used herein refers to a multi-layer composite sheet comprising a web of meltblown fibers sandwiched between and bonded to two spunbond layers. A SMS nonwoven fabric can be formed in-line by sequentially depositing a first layer of spunbond fibers, a layer of meltblown fibers, and a second layer of spunbond fibers on a moving porous collecting surface. The assembled layers can be bonded by passing them through a nip formed between two rolls that can be heated or unheated and smooth or patterned. Alternately, the individual spunbond and meltblown layers can be pre-formed and optionally bonded and collected individually such as by winding the fabrics on wind-up rolls. The individual layers can be assembled by layering at a later time and bonded together to form a SMS nonwoven fabric. Additional spunbond and/or meltblown layers can be incorporated in the SMS fabric, for example spunbond-meltblown-meltblown-spunbond (SMMS), etc.

The term "multiple component fiber" as used herein refers to a fiber that is composed of at least two distinct polymeric components that have been spun together to form a single fiber. The at least two polymeric components are arranged in distinct substantially constantly positioned zones across the cross-section of the multiple component fibers, the zones extending substantially continuously along the length of the fibers. The multiple component spunbond fibers forming the spunbond fabric of the present invention are preferably bicomponent fibers made from two distinct polymer components, a first polymeric component forming the sheath, and a second polymeric component forming the core. Sheath-core fibers are known in the art and have a cross-section in which the core component is positioned in the interior of the fiber and extends substantially the entire length of the fiber and is surrounded by the sheath component such that the sheath component forms the outer peripheral surface of the fiber. Another bicomponent cross-section known in the art is a side-by-side cross-section in which the first polymeric component forms at least one segment that is adjacent at least one segment formed of the second polymeric component, each segment being substantially continuous along the length of the fiber with both polymers exposed on the fiber surface. Multiple component fibers are distinguished from fibers that are extruded from a single homogeneous or heterogeneous blend of polymeric materials. However, one or more of the distinct polymeric components used to form the multiple component fibers can comprise a blend of two or more polymeric materials. For example, the sheath-core fibers forming the spunbond fabric of the present invention comprise a sheath that is a blend of at least two different polymeric materials. The term "multiple component nonwoven web" as used herein refers to a nonwoven web comprising multiple component fibers. The term "bicomponent web" as used herein refers to a nonwoven web comprising bicomponent fibers. A multiple component web can comprise both multiple component and single component fibers.

The acid copolymers used in the sheath component of the sheath-core spunbond fibers of the present invention are selected from the group consisting of copolymers of ethylene with methacrylic acid, acrylic acid, or combinations thereof, metal salts of said copolymers ("ionomers"), and blends thereof. Preferred non-ionomeric acid copolymers have an acid content (acrylic acid, methacrylic acid, or combination thereof) of between about 4 and 20 weight, more preferably between about 4 and 15 weight percent. Non-ionomeric acid copolymers suitable for use in the present invention are available commercially from a number of sources and include Nucrel® resins, available from E.I. du Pont de Nemours and Company (Wilmington, Del.). Ionomers suitable for use as the acid copolymer in the sheath component of the multiple component spunbond fibers of the present invention are prepared by partial neutralization of an acid copolymer with an ionizable metal compound, such as a metal hydroxide. The ionomer preferably contains about 5 to 25 weight percent, preferably 8 to 20 weight percent, and most preferably 8 to 15 weight percent of acrylic acid, methacrylic acid, or combinations thereof. Preferably between about 5 to 70 percent, more preferably between about 25 to 60 percent of the acid groups are neutralized with metal ions. Preferred metal ions include sodium, zinc, lithium, magnesium, and combinations thereof. Optionally, the ionomer can be a terpolymer in which a third monomer, comprising an alkyl acrylate wherein the alkyl group has between 1 and 8 carbons, is co-polymerized with the ethylene and acrylic acid (or methacrylic acid or combination thereof with acrylic acid). This is referred to as a "softening" monomer and can be present up to about 40 weight percent based on total monomer. Ionomers suitable for use in the present invention are available commercially from a number of sources and include Surlyn® ionomer resins, available from E.I. du Pont de Nemours and Company (Wilmington, Del.). The acid copolymers exhibit improved "hot tack" (the molten polymer forms a strong bond to itself) and "heat seal" (strong bonds can be formed over a wide range of temperature and maintained at room temperature) properties. The acid copolymers are also believed to be gamma-radiation stable, similar to polyethylene, under conditions used for gamma sterilization. Non-ionomeric ethylene acrylic/methacrylic acid copolymers may be preferred over ionomers because they are less expensive. The ionomers may also be more moisture sensitive.

If the acid content of the acid copolymer is too low, the improved bonding will not be realized. If the acid content is too high, processing problems may occur due to the low stick temperature of the acid copolymers. For example, pellets comprising the acid copolymer may stick together. The acid copolymers preferably have a melt index in the range of about 5 to 50 g/10 min (measured according to ASTM D-1238; 2.16 kg @ 190° C.). The acid copolymers preferably have a melting point that is less than the melting point of the polyethylene used in the sheath.

The polyethylene used in the sheath component of the sheath-core spunbond fibers can be linear low density polyethylene, high density polyethylene, or a blend thereof. The melt index of the polyethylene is preferably in the range of about 10 to 40 g/10 min (measured according to ASTM D-1238; 2.16 kg @ 190° C.), more preferably in the range of about 15 to 30 g/10 min. Linear low density polyethylene is generally preferred, and has been found to spin better than high density polyethylene in a bicomponent spunbond process and also provides a softer hand than high density polyethylene, which is desirable in certain end uses such as in medical garments or other apparel.

The sheath component of the spunbond fibers preferably comprises between about 5 and 30 weight percent of the acid copolymer, more preferably between about 5 and 20 weight percent of the acid copolymer. At higher levels of acid copolymer, spinning problems may occur such as formation of drips on the spinneret face and sticking of the fibers to each other and to surfaces of the laydown jet. The polyethylene and the acid copolymer can be blended together to form the sheath component prior to extrusion in a spunbonding process, either by melt blending or dry blending. Melt blending can be accomplished with conventional blending equipment such as mixing extruders, Brabender mixers, Banbury mixers, roll mills, etc. The melt blend can be extruded and the extrudate cut to form pellets which can be fed to the spunbonding process. Alternately, pellets of polyethylene and pellets of the acid copolymer can be dry blended and fed as a blend of pellets to the spunbonding process, with the pellets of each component being metered at a rate to produce the desired ratio of polyethylene to acid copolymer. The acid copolymer can also be added to the polyethylene polymer stream in an extruder using an additive feeder in a spunbond process.

Polyesters suitable for use in the core component of the multiple component spunbond nonwovens of the present invention include poly(ethylene terephthalate), poly(1,3-propylene terephthalate), and copolymers thereof with 5-sulfoisophthalic acid. In a preferred embodiment, the polyester component is poly(ethylene terephthalate) having a starting intrinsic viscosity in the range of 0.4 to 0.7 dl/g (measured according to ASTM D 2857, using 25 vol. % trifluoroacetic acid and 75 vol. % methylene chloride at 30° C. in a capillary viscometer), more preferably 0.5 to 0.6 dl/g. Polyamides suitable for use in the core component of the multiple component spunbond nonwovens of the present invention include poly(hexamethylene adipamide) (nylon 6,6), polycaprolactam (nylon 6), and copolymers thereof.

The sheath and/or core component of the sheath-core spunbond fibers can include other conventional additives such as dyes, pigments, antioxidants, ultraviolet stabilizers, spin finishes, and the like.

The multiple component spunbond webs of the present invention can be prepared using spunbonding methods known in the art, for example as described in Rudisill, et al. U.S. Patent application Ser. No. 60/146,896 filed on Aug. 2, 1999, which is hereby incorporated by reference (published as PCT Application WO 01/09425). The multiple component spunbonding process can be performed using either pre-coalescent dies, wherein the distinct polymeric components are contacted prior to extrusion from the extrusion orifice, or post-coalescent dies, in which the distinct polymeric components are extruded through separate extrusion orifices and are contacted after exiting the capillaries to form the multiple component fibers.

Spunbond fibers are generally round but can be made in a variety of other shapes (e.g. oval, tri-lobal or multi-lobal, flat, hollow, etc.). The multiple component sheath-core spunbond fibers can have either a concentric or laterally eccentric cross-section. Laterally eccentric cross-sections are known in the art and generally produce fibers having three-dimensional crimp. The weight ratio between the sheath component and the core component of the spunbond fibers is preferably between about 10:90 and 90:10, more preferably between about 30:70 and 70:30, and most preferably between about 40:60 and 60:40.

The spunbond webs of the present invention can be thermally bonded using methods known in the art. In one embodiment, the spunbond web is thermally bonded with a discontinuous pattern of points, lines, or other pattern of intermittent bonds using methods known in the art. Intermittent thermal bonds can be formed by applying heat and pressure at discrete spots on the surface of the spunbond web, for example by passing the layered structure through a nip formed by a patterned calender roll and a smooth roll, or between two patterned rolls. One or both of the rolls are heated to thermally bond the fabric. When fabric breathability is important, such as in garment end uses, the fabrics are preferably bonded intermittently to provide a more breathable fabric.

The bonding conditions and bonding pattern can be selected to provide the desired combination of strength, softness, and drapeability in the bonded fabric. For the sheath-core spunbond webs of the present invention, a roll bonding temperature in the range of 110° C.-130° C. and a bonding nip pressure in the range of 100-400 pounds/linear inch (175-700 N/cm) has been found to provide good thermal bonding. The optimum bonding temperature and pressure are functions of the line speed during bonding, with faster line speeds generally requiring higher bonding temperatures.

During thermal pattern bonding, the acid copolymer in the sheath component of the spunbond fibers is partially melted in the discrete areas corresponding to raised protuberances on the patterned roll to form fusion bonds that bond the spunbond fibers together to form a cohesively bonded spunbond sheet. Depending on the bonding conditions and polymers used in the sheath component, the polyethylene in the sheath component may also be partially melted during thermal pattern bonding. The polyester or polyamide core component is not melted during thermal bonding and contributes to the strength of the fabric. The bonding roll pattern may be any of those known in the art, and preferably is a pattern of discrete point or line bonds.

The spunbond webs can also be thermally bonded using ultrasonic energy, for example by passing the fabric between a horn and a rotating anvil roll, for example an anvil roll having a pattern of protrusions on the surface thereof.

Alternately, the spunbond webs can be bonded using through-air bonding methods known in the art, wherein heated gas such as air is passed through the fabric at a temperature sufficient to bond the fibers together where they contact each other at their cross-over points while the fabric is supported on a porous surface.

It has been found that the thermally bonded spunbond webs of sheath-core fibers of the present invention have higher grab tensile strength than a comparable spunbond web of sheath-core fibers wherein the sheath component does not contain the acid copolymer. This is believed to be due to improved bonding between the fibers within the spunbond layer. The thermally bonded spunbond fabrics of the present invention preferably have a ratio of grab tensile strength to basis weight of at least 5 lb per oz/yd$^2$ (0.66 N per g/m$^2$), measured in both the machine direction and the cross-direction of the fabric.

Additionally, the multiple component spunbond nonwoven webs of the present invention provide improved bonding between layers when laminated or bonded to other layers. Because the spunbond materials of the present invention exhibit a significant improvement in strength using relatively low concentrations of the acid copolymer in the sheath component of the sheath-core spunbond fibers, the spunbond webs of the present invention are less expensive to manufacture than those in which the sheath consists essentially of an acid copolymer selected from the group consisting of copolymers of ethylene with methacrylic acid, acrylic acid, or a combination thereof, metal salts of said copolymers, and blends thereof. Furthermore, since the acid copolymers are branched materials, they do not generally spin/attenuate as well as linear polymers such as LLDPE. By blending relatively low levels of the acid copolymer with LLDPE in the sheath of the spunbond fibers, improved spinnability is achieved in addition to providing a spunbond fabric having an improved combination of heat sealing properties, grab tensile strength, and reduced cost compared to using the acid copolymer alone in the sheath.

In one embodiment of the present invention, the multiple component spunbond web of the present invention is thermally bonded to one or more additional sheet-like layers to form a multi-layer composite sheet. For example, the multiple component spunbond web of the present invention can be bonded to one or more additional layers selected from the group consisting of meltblown nonwoven webs, spunbond nonwoven webs, carded nonwoven webs, air-laid nonwoven webs, wet-laid nonwoven webs, spunlaced nonwoven webs, knit fabrics, woven fabrics, and films. For example the multiple component spunbond fabric can be bonded to a breathable microporous film. Microporous films are well known in the art, such as those formed from a polyolefin (e.g. polyethylene) film containing particulate fillers.

In another embodiment of a multi-layer composite sheet of the present invention, a spunbond web of the present invention is thermally bonded on one of its sides to a meltblown web. Alternately, a SMS composite nonwoven fabric can be formed wherein at least one of the spunbond layers comprises a spunbond web according to the present invention. The meltblown web can be a single component meltblown web or a multiple component meltblown web. In one embodiment, a muti-layer composite sheet is formed by sandwiching a bicomponent meltblown web between two spunbond webs of the present invention and bonding the layers together. In one such embodiment, the bicomponent meltblown web is comprised of meltblown fibers having a substantially side-by-side configuration comprising a linear low density polyethylene component and a polyester component. The polyethylene component may comprise from 7% to 99% by weight of the meltblown web. Preferably, the polyethylene component comprises from 7% to 50% by weight of the meltblown web and the polyester component comprises from 50% to 93% by weight of the meltblown web. More preferably, the polyethylene component comprises from 15% to 40% by weight of the meltblown web and the polyester component comprises from 60% to 85% by weight of the meltblown web. Most preferably, the polyethylene component comprises from 20% to 30% by weight of the meltblown web and the polyester component comprises from 70% to 80% by weight of the meltblown web.

Bicomponent meltblown webs useful in forming the multi-layer composite sheets of the present invention can be prepared using meltblowing methods known in the art, for example as described in Rudisill, et al. (WO 01/09425). The bicomponent meltblowing process can be performed using either pre-coalescent dies, wherein the distinct polymeric components are contacted prior to extrusion from the extrusion orifice, or post-coalescent dies, in which the distinct polymeric components are extruded through separate extrusion orifices and are contacted after exiting the capillaries to form the bicomponent fibers. When preparing a SMS fabric, the meltblown fibers can be deposited onto the spunbond layer of the present invention and another spunbond layer formed on said meltblown layer. It will be understood by those skilled in the art that multiple layers of meltblown webs and/or spunbond layers can be formed in such a process. The layered webs can be bonded as described above.

In another embodiment of the present invention, the multiple component spunbond web of the present invention is thermally bonded to a second sheet-like layer which comprises fibers comprising a polyester on at least part of the peripheral surface thereof. While spunbond polyethylene fibers do not bond well to polyester fibers, the multiple component spunbond webs of the present invention have been found to bond well to substrates that contain fibers comprising polyester on at least a part of the surface thereof. For example, the multiple component spunbond webs of the present invention have been found to bond well to spunlaced fabrics comprising polyester fibers such as Sontara® spunlaced nonwoven fabrics available from E. I. du Pont de Nemours and Company (Wilmington, Del.). The spunlaced fabric provides an improved hand compared to the spunbond layer alone. In addition, the spunlaced layer may be rendered more durable than the spunlaced fabric alone by thermally bonding it to the spunbond layer.

Using empirical evidence, one can optimize the degree of bonding of the multiple component spunbond web of the present invention to other sheet-like layers. For example, one can change the amount of acid copolymer in the blend, the melt index of the acid copolymer, and/or the amount of acid in the acid copolymer. More polar copolymers (having higher acid content) may bond better to more polar substrates.

The multiple component spunbond webs of the present invention can be thermally bonded prior to thermal bonding to one or more additional sheet-like layers. Alternately, a substantially non-bonded multiple component spunbond web of the present invention can layered with the desired additional sheet-like layers and the layers thermally bonded together to form a thermal bonded multi-layer composite sheet using thermal bonding methods known in the art such as those described above. During thermal bonding of multi-layer composite sheets, the spunbond fibers in the spunbond web of the present invention are bonded together within the spunbond web, and the fibers on the surface of the spunbond web of the present invention are also bonded to the additional sheet-like layer(s).

For end uses in which the spunbond fabric is used without forming a composite sheet, the spunbond fabric preferably has a basis weight of between 1.2 to 7.0 oz/yd$^2$ (40 to 238 g/m$^2$), preferably between about 1.8 to 5.0 oz/yd$^2$ (61 to 170 g/m$^2$), most preferably between about 1.8 to 3.0 oz/yd$^2$ (61 to 102 g/m$^2$). However, when used in composite sheets, for example combined with one or more meltblown layers or with a film, the basis weight of an individual spunbond layer can be much lower, for example basis weights between about 0.3 and 0.9 oz/yd$^2$ (10 to 31 g/m$^2$), preferably between about 0.5 to 0.7 oz/yd$^2$ (17 to 24 g/m$^2$) are generally useful in composite sheets. Potential end uses for the spunbond fabric of the present invention include heat seal tapes and heat-sealable packaging materials. Multi-layer composite sheets of the present invention are useful in medical or other garments and heat-sealable barrier packaging such as medical packaging.

Test Methods

In the description above and in the examples that follow, the following test methods were employed to determine various reported characteristics and properties. ASTM refers to the American Society for Testing and Materials.

Basis Weight is a measure of the mass per unit area of a fabric or sheet and was determined by ASTM D-3776, which is hereby incorporated by reference, and is reported in g/m$^2$.

Grab Tensile Strength is a measure of the breaking strength of a sheet and was conducted according to ASTM D 5034, which is hereby incorporated by reference, and is reported in Newtons.

Heat Seal Strength between layers was measured for Examples 3A-3C, 4A-4C, and Comparative Examples C and D according to the following procedure. Spunbond fabrics were cut into strips 1 inch (2.54 cm) wide×1.5 inches (3.81 cm) long and sandwiched between two 1 inch (2.54 cm) wide×3 inch (7.62 cm) long Sontara® spunlaced samples. The layered samples were heat sealed using a 2.54 cm width heat seal bar (Sentinel Heat Sealer Model #110 12A3 available from Sencorp, Hyannis, Mass.). The heat sealing was accomplished under the specified temperature for 1 second under 40 psi (275.8 kPa) pressure. The heat-sealed samples were then conditioned for 24 hours at 50% relative humidity and 72° F. (22.2° C.) before being pulled apart by an Instron at a cross-head speed of about 12 inches/min (30.5 cm/min). The maximum force to separate the sealed strip was recorded as the heat seal strength in Newtons. The reported heat seal strength is the average of three (3) samples for Comparative Examples C and D, and the average of five (5) samples for Examples 3A-3C and Examples 4A-4C.

EXAMPLES

Examples 1A and 1B

Examples 1A and 1B demonstrate preparation of a thermally bonded sheath-core spunbond bicomponent fabric of the present invention wherein the sheath of the bicomponent spunbond fibers was made with a blend of an acid copolymer and polyethylene and the core of the spunbond fibers consisted essentially of a polyester.

The polyethylene component was a linear low density polyethylene with a melt index of 20 g/10 minutes (measured according to ASTM D-1238), available from Dow Chemical Co. (Midland, Mich.) as Dow Aspun® 61800-34. The polyester component was poly(ethylene terephthalate) with an intrinsic viscosity of 0.53 dl/g (as measured in U.S. Pat. No. 4,743,504) available from E. I. du Pont de Nemours and Company (Wilmington, Del.) as Crystar® polyester (Merge 4449). The polyester resin was dried in a through-air drier at a air temperature of 120° C., to a polymer moisture content of less than 50 parts per million. The polyethylene polymer was heated to 250° C. and the polyester polymer was heated to 290° C. in separate extruders.

Nucrel® 0910 ethylene-methacrylic acid copolymer comprising 8.7 weight percent methacrylic acid and having a melt index of 10 dg/min (measured according to ASTM D1238), available from E. I. du Pont de Nemours and Company (Wilmington, Del.), was added via an additive feeder to the polyethylene pellets at the throat of the extruder. The separate components were separately extruded and metered to a spin-pack assembly, where the two melt streams were separately filtered and then combined through a stack of distribution plates to provide multiple rows of sheath-core fiber cross-sections. The levels of addition are indicated in Table 1.

The spin-pack assembly consisted of a total of 2016 round capillary openings (28 rows of 72 capillaries in each row). The width of the spin-pack in machine direction was 11.3 cm, and in cross-direction was 50.4 cm. Each of the polymer capillaries had a diameter of 0.35 mm and length of 1.40 mm.

The spin-pack assembly was heated to 295° C. The polymers were spun through the each capillary at a polymer throughput rate of 1.0 g/hole/min. The poly(ethylene terephthalate) component comprised the core and the polyethylene/acid copolymer blend comprised the sheath. The polyester component consisted of 70% of the fiber by weight. The bundle of fibers were cooled in a cross-flow quench extending over a length of 19 inches (48.3 cm). The attenuating force was provided to the bundle of fibers by a rectangular slot jet. The distance between the spin-pack to the entrance to the jet was 25 inches (63.5 cm).

The fibers exiting the jet were collected on a forming belt. Vacuum was applied underneath the belt to help pin the fibers to the belt. The spunbond web was thermally bonded between an engraved oil-heated metal calender roll and a smooth oil heated metal calender roll. Both rolls had a diameter of 466 mm. The engraved roll had a chrome coated non-hardened steel surface with a diamond pattern having a point size of 0.466 $mm^2$, a point depth of 0.86 mm, a point spacing of 1.2 mm, and a bond area of 14.6%. The smooth roll had a hardened steel surface. Both rolls were heated to 110° C. roll temperature and 400 lb/linear inch (700 N/cm) nip pressure was used. The thermally bonded sheet was wound onto a wind-up roll. Spunbond sheet properties are reported for the thermally bonded sheets in Table 1 below.

Comparative Example A

The spunbond sheet of this example was prepared as described in Examples 1A and 1B above, except that the polymeric sheath component of the spunbond fibers consisted essentially of the Dow Aspun® 61800-34 linear low density polyethylene. Spunbond sheet properties are reported for the thermally bonded sheet in Table 1 below.

TABLE 1

Spunbond Sheet properties

| | Example 1A | Example 1B | Comp. Example A |
|---|---|---|---|
| wt % Nucrel ® in Sheath | 3.8 | 12.0 | 0 |
| Basis Weight ($g/m^2$) | 42.54 | 43.53 | 42.07 |
| Grab Tensile Strength (XD), (N) | 112.14 | 125.48 | 90.70 |
| Grab Tensile Strength (MD), (N) | 155.38 | 183.44 | 133.09 |

The above results demonstrate the improvement in grab tensile strength of the thermally bonded bicomponent spunbond web containing a blend of LLDPE/acid copolymer in the sheath compared to the comparative example wherein the sheath consisted essentially of LLDPE.

Examples 2A and 2B

Examples 2A and 2B demonstrate preparation of a thermally bonded multi-layer SMS nonwoven sheet according to the present invention. The spunbond layers used for Example 2A were prepared in a process similar to that described for Example 1A above and the spunbond layers used for Example 2B were prepared in a process similar to that used for Example 1B above. Each of the spunbond layers had a basis weight of 0.65 $oz/yd^2$ (22.04 $g/m^2$), which was achieved by increasing the speed of the collection belt compared to Examples 1A and 1B.

The meltblown layer was a bicomponent meltblown web comprising side-by-side meltblown fibers comprising a polyethylene component and a polyester component. The polyethylene component used to prepare the meltblown web was linear low density polyethylene with a melt index of 135 g/10 minutes (measured according to ASTM D-1238) available from Equistar Chemicals as Equistar GA 594-000. The polyester component was poly(ethylene terephthalate) with an intrinsic viscosity of 0.53 dl/g (as measured in U.S. Pat. No. 4,743,504) available from DuPont as Crystar® polyester (Merge 4449). The polyethylene polymer was heated to 260° C. and the polyester polymer was heated to 305° C. in separate extruders.

The two polymers were separately extruded and metered to a melt-blowing die assembly. The two polymer streams were independently filtered in this die assembly and then combined to provide a side-by-side fiber cross section. The die had 624 capillary openings arranged in a 52.4 cm line and was heated to 305° C. The polymers were spun through each capillary at a polymer throughput rate of 0.80 g/hole/min.

Attenuating air was heated to a temperature of 305° C. and supplied at a pressure of 6 psig (41.4 kPa) through two 1.5 mm wide air channels. The two air channels ran the length of the 52.4 cm line of capillary openings, with one channel on each side of the line of capillaries set back 1.5 mm from the capillary openings. The polyethylene was supplied to the spin pack at a rate of 6.0 kg/hr and the polyester was supplied to the spin pack at a rate of 24.0 kg/hr. A bicomponent meltblown web was produced that was 20 weight percent polyethylene and 80 weight percent polyester. The meltblown fibers were collected at a die-to-collector distance of 13.7 cm on a moving forming screen to produce a meltblown web. The meltblown web was collected on a roll. The meltblown web had a basis weight of 17 g/m$^2$.

The meltblown web was sandwiched between two spunbond webs and the layered structure was bonded in a nip comprised of heated embosser and anvil rolls described above. The bonding conditions were 110° C. roll temperature, 200 lb/linear inch (350 N/cm) nip pressure, and a line speed of 20 m/min. SMS sheet properties are reported for the thermally bonded multi-layer sheets in Table 2 below.

Comparative Example B

The multi-layer SMS sheet of this example was prepared as described in Examples 2A and 2B above, except that the polymeric sheath component of the spunbond fibers consisted essentially of the Dow Aspun® 61800-34 linear low density polyethylene. SMS sheet properties are reported for the thermally bonded multi-layer sheet in Table 2 below.

TABLE 2

| | SMS Sheet properties | | |
|---|---|---|---|
| | Example 2A | Example 1B | Comp. Example B |
| wt % Nucrel ® in Sheath (Spunbond layer) | 3.8 | 12.0 | 0 |
| Basis Weight g/m$^2$ | 61.97 | 63.70 | 63.29 |
| Grab Tensile Strength (XD), N | 109.83 | 128.82 | 101.02 |
| Grab Tensile Strength (MD), N | 171.35 | 193.68 | 151.95 |

The above results demonstrate the improvement in grab tensile strength of the thermally bonded SMS multi-layer composite sheets when the sheath component of the bicomponent spunbond web is made from a blend of LLDPE/acid copolymer compared to the comparative example wherein the sheath consisted essentially of LLDPE.

Examples 3A-3C

These examples demonstrate bonding of a bicomponent spunbond layer according to the present invention to a Sontara® polyester spunlaced fabric.

The spunbond layer consisted of sheath-core spunbond fibers wherein the sheath comprised 30 weight percent of the spunbond fibers and the core comprised 70 weight percent of the spunbond fibers. The sheath comprised 10 weight percent of Nucrel® 0910 available from E. I. du Pont de Nemours and Company (Wilmington, Del.) and 90 weight percent of linear low density polyethylene with a melt index of 20 g/10 minutes (measured according to ASTM D-1238), available from Dow Chemical Co. (Midland, Mich.) as Dow Aspun® 61800-34. The polyester core component was poly (ethylene terephthalate) with an intrinsic viscosity of 0.53 dl/g (as measured in U.S. Pat. No. 4,743,504) available from E. I. du Pont de Nemours and Company (Wilmington, Del.) as Crystar® polyester (Merge 4449). The spunbond fabrics were prepared using the process conditions and spinning apparatus described above for Examples 1A and 1B. Examples 3A, 3B, and 3C were prepared having basis weights of 50 g/m$^2$, 40 g/m$^2$, and 20 g/m$^2$ respectively.

The spunbond layers were heat sealed between two layers of Sontara® 8003 spunlaced polyester fabric having a basis weight of 1.2 oz/yd$^2$ (40.7 g/m$^2$), available from E. I. du Pont de Nemours and Company (Wilmington, Del.) and tested for heat seal strength using the test method described above. Temperatures used during heat sealing and heat seal strengths are reported in Table 3 below.

Examples 4A-4C

These examples demonstrate bonding of a bicomponent spunbond layer according to the present invention to a Sontara® polyester spunlaced fabric.

The spunbond layer consisted of sheath-core spunbond fibers wherein the sheath was a blend of LLDPE and an ionomer. The polyethylene used was Dow Aspun® 61800-34. In Example 4A, the sheath comprised 9 wt % of the fibers and in Examples 4B and 4C the sheath comprised 10 wt % of the fibers. In Example 4A, the sheath contained 10 wt % of Surlyn® 8660 ionomer available from E. I. du Pont de Nemours and Company (Wilmington, Del.). Surlyn® 8660 ionomer is an ethylene/methacrylic acid copolymer in which the methacrylic acid groups units have been partially neutralized with sodium ions and has a melt flow index of 10 g/10 min (measured according to ASTM D-1238 at 190° C.). In Examples 4B and 4C the sheath contained 20 wt % of the Surlyn® ionomer. The spunbond fabrics were prepared using the process conditions and spinning apparatus described above for Examples 1A and 1B. The spunbond fabrics used in Examples 4A, 4B, and 4C had a basis weight of 20 g/m$^2$, 40 g/m$^2$, and 30 g/m$^2$, respectively.

The spunbond layers were heat sealed between two layers of Sontara® 8003 spunlaced polyester fabric and tested for heat seal strength as described in the test method above. Temperatures used during heat sealing and heat seal strengths are reported in Table 3 below.

Comparative Examples C and D

These examples demonstrate bonding of a bicomponent spunbond layer to a Sontara® polyester spunlaced fabric wherein the sheath of the bicomponent spunbond fibers comprises a blend of linear low density polyethylenes.

The sheath of the spunbond fibers comprised 30 weight percent of the fibers and comprised 80 wt % Dow Aspun® 61800-34 LLDPE and 20 wt % Dow Aspun® 6811A LLDPE having a melt index of 27 g/10 minutes (measured according to ASTM D-1238). The spunbond layers were prepared using the process conditions and spinning apparatus described above for Examples 1A and 1B. The spunbond layer used in Comparative Example C had a basis weight of 40 g/m$^2$ and the spunbond layer used in Comparative Example D had a basis weight of 20 g/m$^2$.

The spunbond layers were heat sealed between two layers of Sontara® 8003 spunlaced polyester fabric and tested for heat seal strength as described in the test method above. Temperatures used during heat sealing and heat seal strengths are reported in Table 3 below.

TABLE 3

Heat Seal Strengths for Thermal-Bonded Spunbond-Spunlaced Multi-Layer Composite Sheets

| Spunbond Fabric - Example No. | Heat Seal Temp (° C.) | Heat Seal Strength (N) Avg | Heat Seal Strength (N) Std. Dev. |
|---|---|---|---|
| 3A | 200 | 12.17 | 3.03 |
| " | 225 | 13.87 | 2.13 |
| " | 250 | 14.75 | 2.13 |
| 3B | 200 | 14.59 | 4.42 |
| " | 225 | 13.59 | 1.25 |
| " | 250 | 13.30 | 2.02 |
| 3C | 200 | 5.28 | 2.00 |
| " | 225 | 0.14[1] | melted |
| " | 250 | 0.16[1] | melted |
| 4A | 200 | 1.54 | 0.58 |
| | 225 | 1.70 | 1.01 |
| | 250 | 0.14[1] | melted |
| 4B | 200 | 0.94 | 0.17 |
| " | 225 | 2.08 | 1.24 |
| " | 250 | 4.68 | 1.29 |
| 4C | 200 | 1.26 | 0.51 |
| " | 225 | 2.19 | 0.94 |
| " | 250 | 6.28 | 1.60 |
| Comparative Ex C | 200 | 0.62 | 0.19 |
| " | 225 | 0.68 | 0.12 |
| " | 250 | 1.11 | 0.20 |
| Comparative Ex D | 200 | 0.44 | 0.02 |
| " | 225 | 0.59 | 0.10 |
| " | 250 | 1.03 | 0.11 |

[1]Spunbond layer melted through the Sontara ® spunlace fabric, thereby invalidating the test These examples demonstrate the improvement in heat seal strength between the spunbond layer and the Sontara® spunlaced fabric for the examples of the present invention compared to the comparative examples in which the sheath of the sheath/core spunbond layer does not contain any acid copolymer additive.

The examples using the Nucrel® acid copolymer provided the highest heat seal strengths. In some of the examples of the invention using spunbond layers having a basis weight of 20 g/m$^2$, the spunbond layer was observed to melt through the Sontara® spunlace layer at the higher bonding temperatures, resulting in a significant reduction in the heat seal strength. Melting of the spunbond layer as occurred in certain examples can be avoided by selecting the appropriate bond temperature and line speed when preparing materials in a commercial process.

The samples prepared in the Comparative Examples had very low heat seal strengths. When the spunbond layer is not used and two Sontara® spunlaced layers are subjected to identical heat seal test conditions, the spunlaced layers did not bond to each other.

What is claimed is:

1. A multi-layer composite sheet comprising:

a first multiple component spunbond nonwoven web having a first side and a second side and comprising polymeric sheath-core substantially continuous spunbond fibers wherein the sheath component comprises a blend comprising polyethylene and between about 5 and 30 weight percent of an acid copolymer selected from the group consisting of copolymers of ethylene with methacrylic acid, copolymers of metal salts of ethylene with methacrylic acid, copolymers of metal salts of ethylene with acrylic acid, or a combination thereof, the core component comprises a polymer selected from the group consisting of polyesters and polyamides, and the weight ratio of sheath component to core component is between about 10:90 and 90:10, wherein the spunbond web is thermally bonded and has a ratio of grab tensile strength to basis weight of at least 0.66 N per g/m$^2$ in both the machine direction and the cross-direction, and a sheet-like layer thermally bonded to the first side of the multiple component spunbond nonwoven web, the sheet-like layer selected from the group consisting of nonwoven webs, woven fabrics, knit fabrics, and films.

2. The multi-layer composite sheet of claim 1 wherein the sheet-like layer is a nonwoven web selected from the group consisting of meltblown webs and spunlaced webs.

3. The multi-layer composite sheet of claim 2 wherein the sheet-like layer is a spunlaced web comprising polyester fibers.

4. The multi-layer composite sheet of claim 2 wherein the sheet-like layer is a meltblown web comprising meltblown fibers having an outer peripheral surface comprising polyester.

5. The multi-layer composite sheet of claim 1, further comprising a second multiple component spunbond nonwoven web according to claim 1, wherein the sheet-like layer is sandwiched between and thermally bonded to the first and second spunbond layers.

6. The multi-layer composite sheet of claim 5, wherein the core components of both the first and second multiple component spunbond webs are substantially free of acid copolymer.

7. The multi-layer composite sheet of claim 6, wherein the sheet-like layer is a meltblown web comprising meltblown fibers having an outer peripheral surface comprising polyester.

8. The multi-layer composite sheet of claim 7, wherein the meltblown fibers are bicomponent fibers.

9. The multi-layer composite sheet of claim 8 wherein the meltblown fibers further comprise linear low density polyethylene and the linear low density polyethylene and polyester components in the meltblown fibers are arranged in a side-by-side configuration.

10. The multi-layer composite sheet of claim 7 wherein the polyethylene in the sheath component of the spunbond fibers of the first and second multiple component spunbond webs is linear low density polyethylene, the acid copolymer is a copolymer of ethylene and an acid comonomer selected from the group consisting of acrylic acid, methacrylic acid, and blends thereof, the acid copolymer has an acid content between about 4 and 20 weight percent, and the core component of the spunbond fibers of the first and second multiple component webs comprises poly(ethylene terephthalate).

11. The multi-layer composite sheet of claim 3 wherein the polyethylene in the sheath component of the spunbond fibers of the first and second multiple component spunbond webs is linear low density polyethylene, the acid copolymer is a copolymer of ethylene and an acid comonomer selected from the group consisting of acrylic acid, methacrylic acid, and blends thereof, the acid copolymer has an acid content between about 4 and 20 weight percent, and the core component of the spunbond fibers of the first and second multiple component webs comprises poly(ethylene terephthalate).

12. The multi-layer composite sheet according to claim 1 further comprising a second sheet-like layer thermally bonded to the second side of the multiple component spunbond nonwoven web so that the multiple component spunbond web is sandwiched between the sheet-like layers, wherein the second sheet-like layer is selected from the group consisting of nonwoven webs, woven fabrics, knit fabrics, and films.

13. The multi-layer composite sheet according to claim 12 wherein the first and second sheet-like layers are selected from the group consisting of spunlaced webs, spunbond webs, knit fabrics, and woven fabrics.

14. The multi-layer composite sheet according to claim 13 wherein the sheet-like layers are thermally point bonded to the multiple component spunbond web.

15. The multi-layer composite sheet according to claim 14 wherein the first and second sheet-like layers comprise spunlaced webs.

* * * * *